United States Patent [19]

Aboud

[11] 3,958,785

[45] May 25, 1976

[54] MULTI-LEGGED TRASH BAG HOOP

[76] Inventor: Fred George Aboud, 3812 Taylorsville Rd., Louisville, Ky. 40220

[22] Filed: Dec. 26, 1974

[21] Appl. No.: 536,412

Related U.S. Application Data

[63] Continuation-in-part of Ser. No. 394,351, Sept. 4, 1973, abandoned, which is a continuation-in-part of Ser. No. 271,634, July 13, 1972, abandoned.

[52] U.S. Cl. ..... 248/97; 141/390; 248/99; 248/150; 248/151

[51] Int. Cl.[2] ..... B65B 67/04

[58] Field of Search ..... 248/97, 99, 100, 101, 248/95, 94, 150, 151, 166, 168; 141/314, 316, 390, 391; 15/257.1, 257.3, 257.7; 150/2, 12; 53/390

[56] References Cited

UNITED STATES PATENTS

| | | | |
|---|---|---|---|
| 982,302 | 1/1911 | Roncaglia | 248/166 |
| 1,414,575 | 5/1922 | McCart | 248/97 |
| 1,545,279 | 7/1925 | Ross | 248/168 X |
| 1,714,308 | 5/1929 | Gunderson | 141/390 |
| 3,180,384 | 4/1965 | Seifert | 248/95 X |
| 3,253,812 | 5/1966 | Okazaki | 248/97 |
| 3,627,243 | 12/1971 | Farrelli | 248/99 |
| 3,638,888 | 2/1972 | Ross | 248/97 |
| 3,697,030 | 10/1972 | Schultz | 248/101 |
| 3,754,785 | 8/1973 | Anderson | 248/99 X |
| 3,822,524 | 7/1974 | Jerpbak | 141/390 X |

FOREIGN PATENTS OR APPLICATIONS

| | | | |
|---|---|---|---|
| 70,189 | 11/1949 | Denmark | 141/390 |
| 256,146 | 7/1948 | Switzerland | 248/95 |
| 259,620 | 1/1949 | Switzerland | 248/95 |
| 121,064 | 3/1948 | Sweden | 248/100 |

*Primary Examiner*—Roy D. Frazier
*Assistant Examiner*—Rodney H. Bonck
*Attorney, Agent, or Firm*—Arthur F. Robert

[57] ABSTRACT

A circular hoop, through which the upper mouth end portion of a trash bag may be extended upwardly and then inverted annularly outward and downward over the hoop, is provided with three legs at 120° intervals. The legs are pivotally secured to the hoop for movement between an upper horizontal storage position in which they extend along and conform to the outside surface of the hoop and a vertical supporting position in which they curve vertically downward and inward from their pivotal connections to support the hoop horizontally at a given elevation for vertical loading purposes, the legs being reversible to curve outwardly wherein they cooperate with the hoop to hold the hoop slantwise for horizontal loading purposes.

8 Claims, 6 Drawing Figures

MULTI-LEGGED TRASH BAG HOOP

CROSS REFERENCES TO RELATED APPLICATIONS

This is a continuation-in-part of my Sept. 4, 1973 application Ser. No. 394,351, now abandoned, which is a continuation-in-part of my July 13, 1972 application Ser. No. 271,634, now abandoned.

BACKGROUND OF THE INVENTION

1. Field of the Invention

This invention relates to a hoop of the type intended for removable securement to a trash bag mouth so as to hold the mouth of an unfilled bag open and to facilitate manually lifting or removing a loaded bag from a trash container and carrying it to a desired disposal point. While the invention is primarily intended for use in connection with trash bags, it may be used in connection with bags devoted to other purposes.

2. Description Of The Prior Art

The U.S. patents to Lyon U.S. Pat. No. 611,498, Mason U.S. Pat. No. 949,024, Yount U.S. Pat. No. 1,097,701 and Jensen U.S. Pat. No. 3,614,042 show various hoop arrangements for holding the mouth of a bag open and for supporting the bag itself. The U.S. patents to Seifert U.S. Pat. No. 3,180,384 and Okazaki U.S. Pat. No. 3,253,812 each show a hoop through which the mouth of a bag may be extended upwardly and annularly inverted outwardly over the hoop with another hoop fitting thereover to clamp the open mouth of the bag between hoops. The Swiss patent to Kuster No. 256,146 and the Danish patent to Christiansen No. 70,189 each show a hoop with three legs permanently secured at about 120° intervals to project straight downwardly from that hoop, Kuster's upper ends projecting above the hoop and being forked for bag retention purposes. The U.S. patents to Roncaglia U.S. Pat. No. 982,302 and Carson U.S. Pat. No. 1,213,743 respectively show rectangular-stove and circular-strainer frames, each having four legs pivoted thereto for movement between vertical and horizontal positions. The Aitkens et al. British Pat. No. 816,860 of 1897 shows a truncated cone *a*, the sides of which flare downwardly, i.e. they extend downwardly and outwardly. Aitkens' cone is intended to be fitted within (or inside) the mouth of a potato bag to rest on the floor with the bottom three-fourths of the bag in a collapsed condition. Potatoes are dumped to fill the cone. The cone is lifted until the bottom of the cone can rest on the periphery of the upper layer of potatoes. The cone is refilled and again lifted and this process repeated until the bag is filled.

SUMMARY OF THE INVENTION

Objects Of The Invention

The principal object of the present invention is to provide a simple inexpensive multi-legged hoop which may be easily secured to and removed from the mouth end portion of a plastic trash bag and which, when secured, is operative to facilitate the vertical or horizontal loading of trash into the bag, to facilitate the manual handling involved in removing a loaded bag from a can and in carrying it to a desired point and to avoid, during such handling, subjecting the bag to localized stresses which are often sufficient to result in its deformation and tearing.

Statement Of The Invention

The objectives of this invention may be readily accomplished by providing a circular hoop, through which the upper mouth end portion of a bag may be extended upwardly and then inverted annularly outward and downward, with say three legs pivotally secured to it at say 120° intervals, each leg being movable between an upper horizontal storage position in which it extends along and conforms to the outside surface of the hoop and a vertical supporting position in which it curves, from its pivotal connection, vertically downward and inward into the space underlying the circular opening of the hoop.

With the legs in their horizontal storage position, the hoop can be positioned over the mouth of a garbage can, containing a loaded trash bag, whereupon the upper end portion of the bag can be extended upwardly through the hoop and then annularly inverted over the hoop to render the hoop useful not only as a circular handle facilitating the manual handling involved in removing the loaded bag upwardly out of the can and carrying it to a desired point but also as a means operative, during such handling, to distribute the load of the bag throughout the entire 360° extent of the handle. Normally, the bag is manually grasped at diametrically opposite points for such handling purposes, causing the load to be concentrated at such points. This subjects the bag to localized stresses which are often sufficient to result in its deformation and tearing.

With an empty bag on the hoop and each leg in its vertical position, the legs function, when placed on a support such as the ground, to hold the open mouth of the bag at a given elevation above ground level so that the elevated portion of the bag can be filled with garbage or leaves. Now the hoop and bag, as an assembly, may be raised enough to drop the contents of the bag partially toward or entirely to the bottom of the bag. When the hoop and bag are lowered as far as they will go, the bottom of the legs engage the bag at the top of the load and thus hold the hoop elevated above the contents of the bag so that the bag may receive additional material. This procedure can be repeated until the bag is filled whereupon the load-distributing hoop can again be used as a circular handle for manual bag-handling purposes.

Furthermore, two of the legs can be reversed so that they curve outwardly. Now, when the hoop and these two legs are made to rest on the ground, the legs function to hold the hoop, and the open mouth portion of an empty bag on the hoop, at an angle of about 75° to the ground. In this position, leaves or other trash may be swept from a lawn or floor horizontally into the bag. If desired, the uppermost leg may be replaced by a leg which extends outwardly upward from the top side of the hoop so as to function as a handle for the hoop. This hoop handle enables a person using the bag holder to hold the upper end of the slanted hoop steady while sweeping material into the bag.

BRIEF DESCRIPTION OF THE DRAWINGS

The invention is illustrated in the accompanying drawing wherein.

DESCRIPTION OF THE PREFERRED EMBODIMENT

Figure 1:
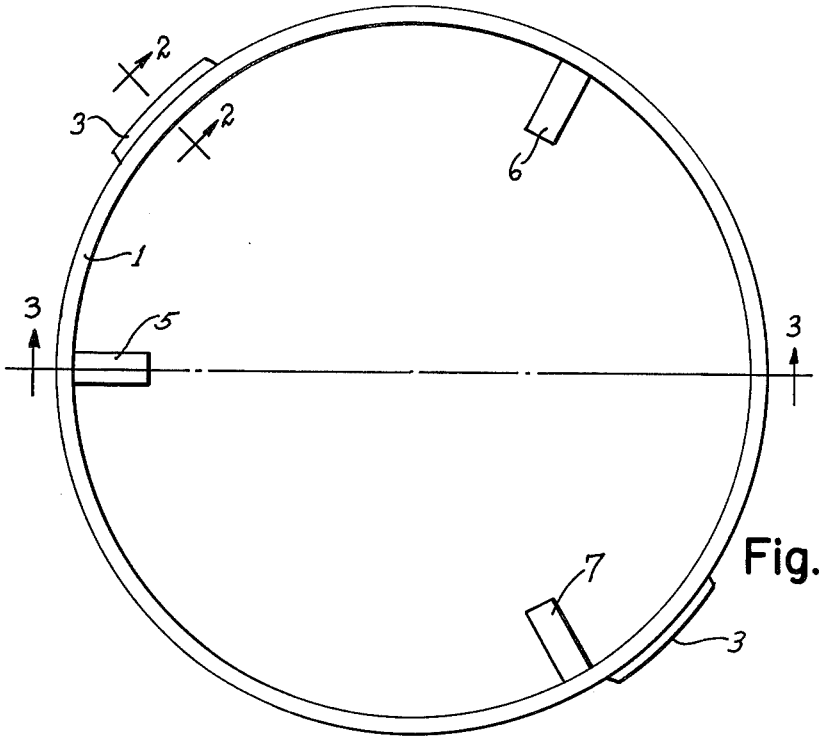
FIG. 1 is a top plan view of one embodiment of a hoop constructed in accordance with my invention, this view showing the legs in their vertical position.
Figure 2:
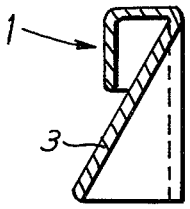
FIG. 2 is a vertical section lines 2—2 of FIG. 1.
Figure 6:
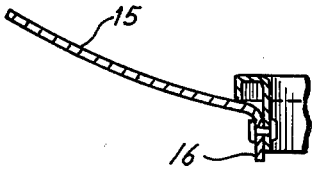
FIG. 6 is a fragmentary view showing a hoop handle secured to the hoop.
Figure 3:
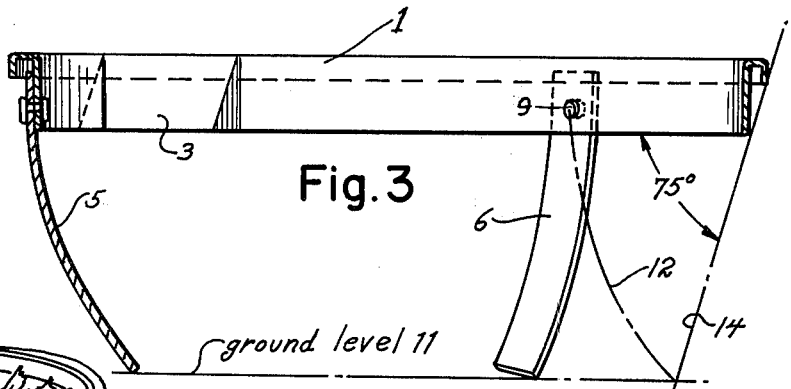
FIG. 3 is a vertical section lines 3—3 of FIG. 1.

In the embodiment illustrated in the drawing, the hoop 1 is preferably in the form of a true circle of plastic or any other suitable material providing the hoop with satisfactory degrees of flexibility, rigidity and strength. It is of inverted J shape in vertical cross-section with the long leg of the J forming the bore of the hoop and with the short leg of the J on the outermost side of the hoop. More particularly, the long leg of the J provides an inner band, the short leg of the J provides an outer band forming the outer periphery of the hoop and cooperating with the inner band to form a downwardly open groove trough characterized by a ceiling between bands. As best seen in FIGS. 2, 3 and 6, the upper end of the hoop is blunt.

That portion of the (bore, top and peripheral) surfaces of the hoop, which contact the mouth end portion of a bag extending upwardly through the opening of the hoop and thence annularly inverted outwardly over the hoop, should be extensive enough in area to provide the frictionally resistive engagement normally required to secure and hold the bag to the hoop without any additional support. Needless to say, such surface should not be slippery smooth. However, if additional securement is required, it may be provided by an elastic band (not shown) which encircles the hoop and grips it in much the same manner as a rubber band would grip it when the normal unexpanded size of the band opening is somewhat smaller than the diameter of the mouth of the hoop.

It is not essential but it may be desirable to provide the hoop with a pair of diametrically opposite handles 3 preferably cast or otherwise formed as an integral part of the hoop when the hoop itself is formed in any of the well known ways.

The hoop is provided with three or more legs 5, 6 and 7, preferably equally spaced. Since only 3 legs are shown, these are spaced at 120° intervals. Each leg is pivotally secured at its upper end to the outer surface of the long leg of the inverted J for movement between the vertical position shown in FIG. 3 wherein each leg extends downward and curves inward, and the horizontal position indicated in FIG. 5, wherein each leg curves horizontally along the under-side of the trough. Each leg is pivotally secured to the hoop by snap fasteners 9 of any suitable form.

With the upper end portion of an empty bag extending upwardly through the hoop and then being annularly inverted over the hoop and with the legs in their vertical position, as seen in FIG. 3 wherein they rest on a supporting base at a given level such as ground level 11, the hoop serves to support the open mouth of the bag at a given initial elevation above the ground level 11. Accordingly, the limited bag space between the mouth of the hoop and ground level 11 may be filled with leaves, or other trash, while the rest of the bag lies collapsed on the ground. When said limited bag space is filled, the bag is raised to drop the contents below the lower end of the legs 5–7. It will be noted that the lower ends of the legs are spaced a substantial distance inward from the intersection of a downward geometrical projection of the circular hoop with the horizontal plane of the bottom of said legs so that, during the process of filling a hoop-mounted bag, the legs are also operative to rest on the top of a partially filled bag and thus support said hoop at an elevation higher than said initial elevation.

Now when the hoop, legs and the corresponding portion of the bag is lowered, the lower end of the legs will engage the sides of the bag and reach a supporting level corresponding to the top of the contents of the bag. Once again, the available top space of the bag may be filled and this operation repeated until the bag is entirely full or otherwise loaded to a desired level. The hoop may now be grasped at its diametrically opposite handles 3 and the whole assembly raised and transported to a desired disposal area. Here the bag may be emptied for reuse or the hoop may be removed and the upper end of the bag tied to await disposal.

When a garbage can is provided with a trash bag liner, the upper ends of that liner should be inverted annularly outward over the mouth of a garbage can and maintained in that condition until the bag has the requisite load. It is difficult to remove a loaded trash bag liner from its container manually because, if it is manually grasped at diametrically opposite points and lifted out of the can, its load presses the bag against the sides of the can which increases the resistance of the bag to the lifting operation and correspondingly renders removal difficult. As a result of this pressure, localized stresses are set up in the bag at the points where the bag is grapsed. These stresses are often sufficiently high to result in deforming and often tearing the bag. This a commonly-experienced nuisance.

With my arrangement, the upper end portion of the loaded trash bag is extended upwardly through the hoop and then inverted annularly outward and downward over the hoop. Now, when the hoop and bag are lifted as a unit, the load is distributed throughout the circular extent of the hoop. Thus, excessive localized stresses are minimized if not eliminated. In other words, my hoop is portable and operative to distribute and support the weight of a loaded bag around the circumference of the hoop during the requisite handling (manually lifting and carrying) of such bag from one point to another.

It is often desired to load a bag horizontally as by sweeping trash from a floor or lawn directly into the bag. With my multi-legged hoop, this can be accomplished by reversing inwardly curving legs 6 and 7 so that they curve outwardly. Thus, leg 6 would curve along line 12 of FIG. 3 while leg 7 (not shown in FIG. 3) would curve along a similar line. With this arrangement, the hoop may be supported at a steep angle upon ground level 14 resting legs 6 and 7 and the intermediate portion of hoop 1 upon ground level 14. With the hoop supported in this slanted position, the user can sweep trash from level 14 horizontally into the open mouth of a bag on the hoop. If additional support is necessary, leg 5 (at the topside of the slanted hoop) may be removed and replaced by a handle 15 having a bent portion 16 fastened to the hoop by fastener 9, the handle 15 being fashioned to extend outwardly and upwardly in a manner making it easy for a user to grasp the handle to steady the hoop. Instead of replacing leg 5 with a separate handle member 15, a suitable handle 15 may be provided by fashioning the upper end portion of leg 5 with a downwardly-turned secured-end portion corresponding to the bent portion 16 of handle 15.

Figure 4:
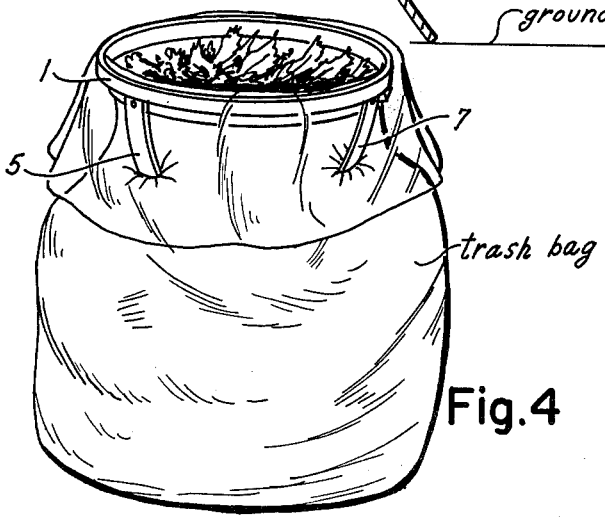
FIG. 4 shows the structure of FIGS. 1–2 in position to hold the mouth of a bag horizontally open at a given elevation above a ground support level.
Figure 5:
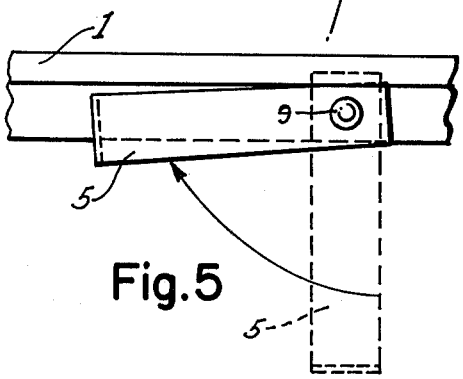
FIG. 5 is a fragmentary view showing a pivotally mounted leg in dotted lines in its vertical position and in full lines in a position just short of its horizontal storage position.

Since the foregoing description makes clear the structure and operation of my mutli-legged trash bag hoop, it should suffice to say: that, with the legs in the storage position indicated in FIG. 5, the hoop 1 is not only useful as a circular handle, facilitating the manual removal of a loaded trash bag upwardly out of a garbage can and the carrying of that loaded bag to a desired disposal point, but it is also operative, during such handling, as a means to distribute the load of the bag more or less evenly throughout the entire 360° extent of the handle; that, with the legs in the vertical position shown in FIG. 3, my device can be used to hold the open mouth of the bag at a given elevation above ground level so that the elevated portion of the bag can be filled with garbage or leaves and then the hoop and bag can be raised and the legs ultimately allowed to rest on top of the contents of the partially filled bag, as shown in FIG. 4, to facilitate loading the bag with another batch of trash; and that my device can be horizontally loaded as indicated in FIG. 3 wherein two of the legs are reversed so that the hoop is supported at an angle of 75° to ground level 14 to permit trash to be swept into the open mouth of the bag.

Having described my invention, I claim:

1. A multi-legged trash bag hoop comprising:

A. an endless circular hoop through which the upper mouth end portion of a trash bag may be extended upwardly and then inverted annularly outward and downward over the hoop.

1. said hoop having alternate positions including a substantially horizontal position for vertical-loading purposes and an inclined position for horizontal-loading purposes;

B. at least three curved legs for supporting the hoop; and

C. means for securing said curved legs to the hoop to extend downwardly and curve inwardly from their securements to support the hoop in said horizontal position for vertical loading purposes, the lower ends of said inwardly-curving legs being spaced a substantial distance inward from the intersection of the horizontal plane of the bottom of said legs with a downward geometric projection of the hoop, said securing means being operative 1. to secure said curved legs pivotally for movement to a storage position wherein they lie adjacent the hoop and conform to the curvature of its periphery, and 2. to secure at least two legs detachably so that they may be detached, reversed and resecured to extend downwardly and curve outwardly in position to cooperate with an intermediate portion of the hoop to hold the hoop in said inclined position.

2. The hoop of claim 1 including:

A. means for providing the upper end of said inclined hoop with an outwardly and upwardly extending handle.

3. The hoop of claim 1 wherein:

A. said endless hoop is manually portable and operative, when used to carry a loaded bag, to distribute and support the weight of the bag around the circumference of the hoop through substantially continuous engagement therewith, 1. said hoop integrally including a. an inner band forming the bore of the hoop and b. an outer band forming the outer periphery of the hoop and cooperating with the inner band to form a downwardly open groove.

4. The hoop of claim 3 wherein:

A. when said hoop is arranged horizontally, said securing means is located below the ceiling of said groove and arranged to effect the pivotal securement of the legs to said inner band for movement from a position in which said legs extend vertically to another position in which said legs extend along the outer side of the inner band and conform to the curvature thereof.

5. The hoop of claim 1 wherein:

A. said legs when extending downwardly in position to engage a horizontal supporting base, are operative, through such engagement, to support the hoop in said horizontal position at a given initial elevation above the level of said base for said vertical loading purposes, 1. said legs, during the process of filling a hoop-mounted bag, also being operative to rest on the top of a partially filled bag and thus support said hoop in a horizontal position at an elevation higher than said given initial elevation.

6. A multi-legged trash bag hoop of the type intended for removable engagement with the exterior of a flexible plastic trash bag liner in a trash can to facilitate manually lifting and removing a loaded bag from the can support and manually carrying it to a desired disposal area, comprising:

A. endless integral circular hoop through which the upper mouth end portion of a loaded trash bag in a trash can may be extended upwardly and then inverted annularly outward and downward over the hoop, 1. said endless hoop being manually portable and operative, when used in lifting and carrying a loaded bag, to distribute and support the weight of the bag more or less uniformly around the circumference of the hoop through substantially continuous engagement therewith and thus minimize the establishment of localized pressures, such as those which are created when the mouth end of the bag alone is manually grasped at spaced points and lifted, 2. said hoop having a smooth blunt upper end and being of inverted trough-shape in cross-section, a. the bag-contacting surfaces of the hoop being frictionally resistive and sufficiently extensive to provide the frictional engagement normally required to secure and hold the bag firmly on the hoop without tearing the bag when it is lifted and carried and without requiring mechanical means for engaging the inner surface of the bag to clamp the bag against the bag holding surfaces of the hoop; and B. leg means for rendering the hoop additionally useful in holding a bag on the hoop in an upright position on a horizontal supporting base such as the ground and maintaining the mouth of the upright bag open during a bag filling operation, said leg means including 1. at least three curved legs, and 2. means for securing the legs pivotally to the circular hoop for movement along the outside of said bag
   a. from one position in which the legs curve horizontally along the underside of the trough
   b. to another position in which the legs extend vertically downward and inward from their securements in position to engage said base and, through such engagement, support the hoop in a horizontal position at a given initial elevation above the level of said base for vertical-loading purposes, the lower ends of the legs being spaced a substantial distance inward from the intersection of the horizontal plane of the bottom of said legs with a downward geometrical projection of the hoop so that, during the process of filling a hoop-mounted bag, said legs are also operative to rest on the top of a partially-filled bag and thus support said hoop at an elevation higher than said initial elevation.

7. The hoop of claim 6 wherein:

A. the specific shape of said inverted U-shaped trough is that of an inverted J having a top bight connecting relatively tall and short side walls including
   1. a tall inner side wall or band forming the bore of the hoop with
   2. a short outer side wall or band forming the outer periphery of the hoop; and B. said securing means is located below the ceiling of said trough and arranged to effect the pivotal securement of the legs to the outer side of said tall inner side wall or band.

8. The hoop of claim 7 including:

A. a pair of diametrically opposite handles formed as an integral part of the the inner wall of said hoop.

* * * * *